United States Patent [19]

Antos et al.

[11] 4,215,445

[45] Aug. 5, 1980

[54] PORTABLE TOILETS

[75] Inventors: John M. Antos; Arthur W. Henke; Erin J. Lindsay, all of Ann Arbor; James T. Embach, Saline, all of Mich.

[73] Assignee: Thetford Corporation, Ann Arbor, Mich.

[21] Appl. No.: 75,795

[22] Filed: Sep. 14, 1979

[51] Int. Cl.[3] ..... E03D 1/00; A47K 11/02; A61L 11/00

[52] U.S. Cl. ..... 4/323; 4/300.1

[58] Field of Search ..... 4/115, 1, 321, 300, 4/322, 323–324, 317, 318, 347, 434, 116, 114, 128

[56] References Cited

U.S. PATENT DOCUMENTS

| | | | |
|---|---|---|---|
| 1,607,302 | 11/1926 | Pentecost | 4/1 |
| 3,171,135 | 3/1965 | Polichio | 4/1 |
| 3,570,018 | 3/1971 | Sargent et al. | 4/115 |
| 3,801,991 | 4/1974 | Fulton et al. | 4/115 |
| 3,851,339 | 12/1974 | Flinner et al. | 4/115 |
| 3,858,249 | 1/1975 | Howard | 4/115 X |
| 4,180,876 | 1/1980 | Sargent et al. | 4/321 |

FOREIGN PATENT DOCUMENTS

| | | | |
|---|---|---|---|
| 1048705 | 2/1979 | Canada | 4/321 |

*Primary Examiner*—Henry K. Artis
*Attorney, Agent, or Firm*—Olsen and Stephenson

[57] ABSTRACT

A portable toilet of the type having two vertically stacked sections, the lower section (12) being a holding tank, and the upper section (14) including a toilet bowl (22), a water tank (26) for storage of water for flush purposes, and a pump (30) for flushing the toilet bowl. To provide a source of chemicals for inserting into the holding tank, a storage chamber (66) is formed in the top wall (38) of the holding tank so as to be confined within the walls (18) of the upper section. To provide a source of toilet tissue paper, a storage chamber (76) is provided between the upper and lower sections (12) and (14) and a toilet tissue paper holder (78) is mounted therein.

11 Claims, 9 Drawing Figures

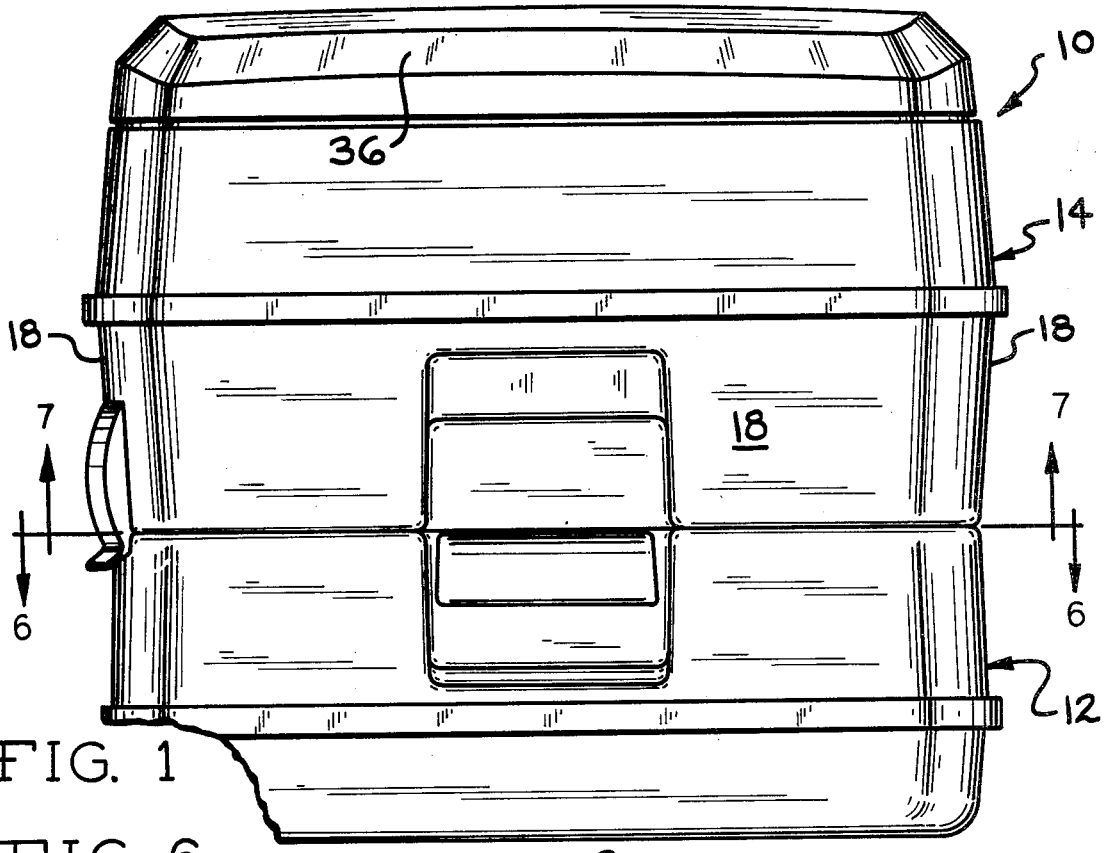
FIG. 1
FIG. 6
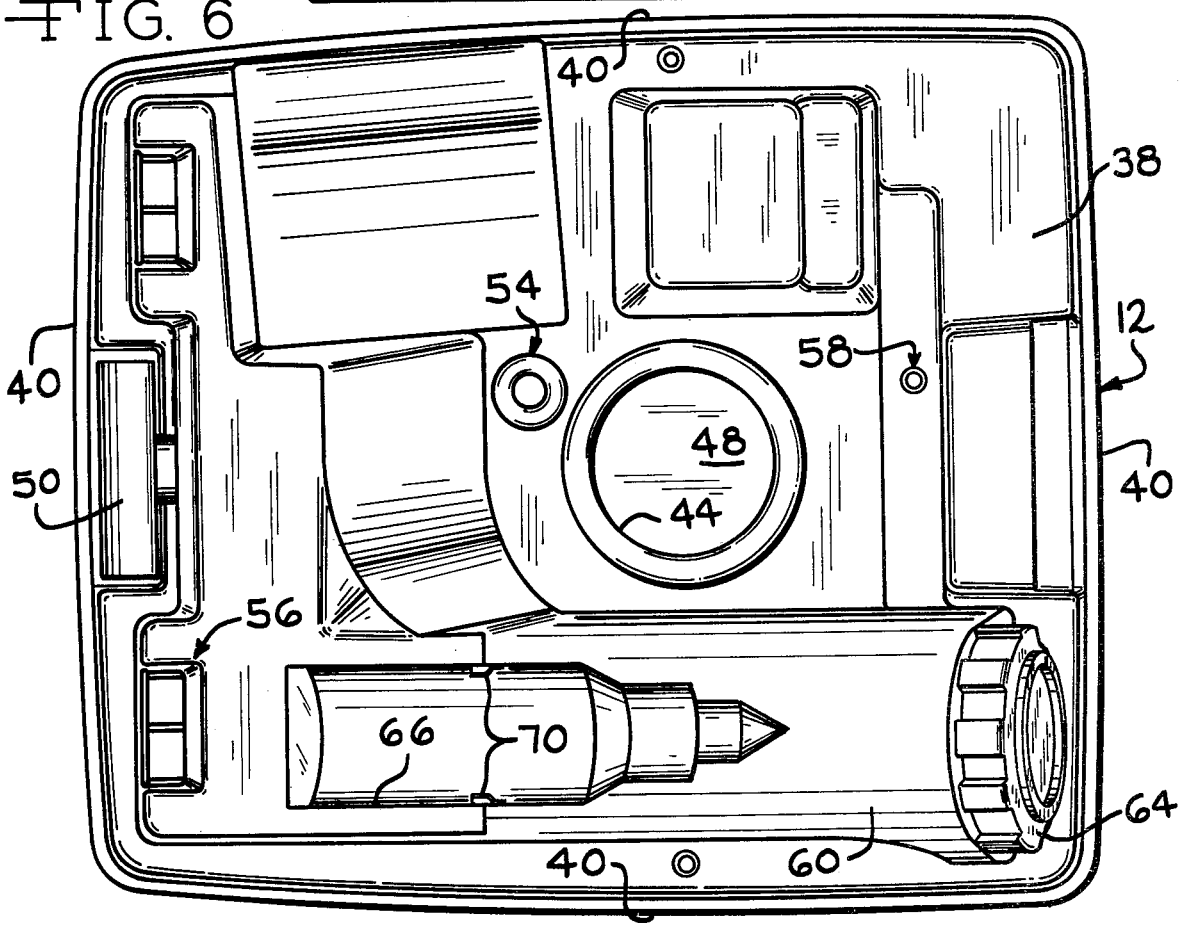

FIG. 4
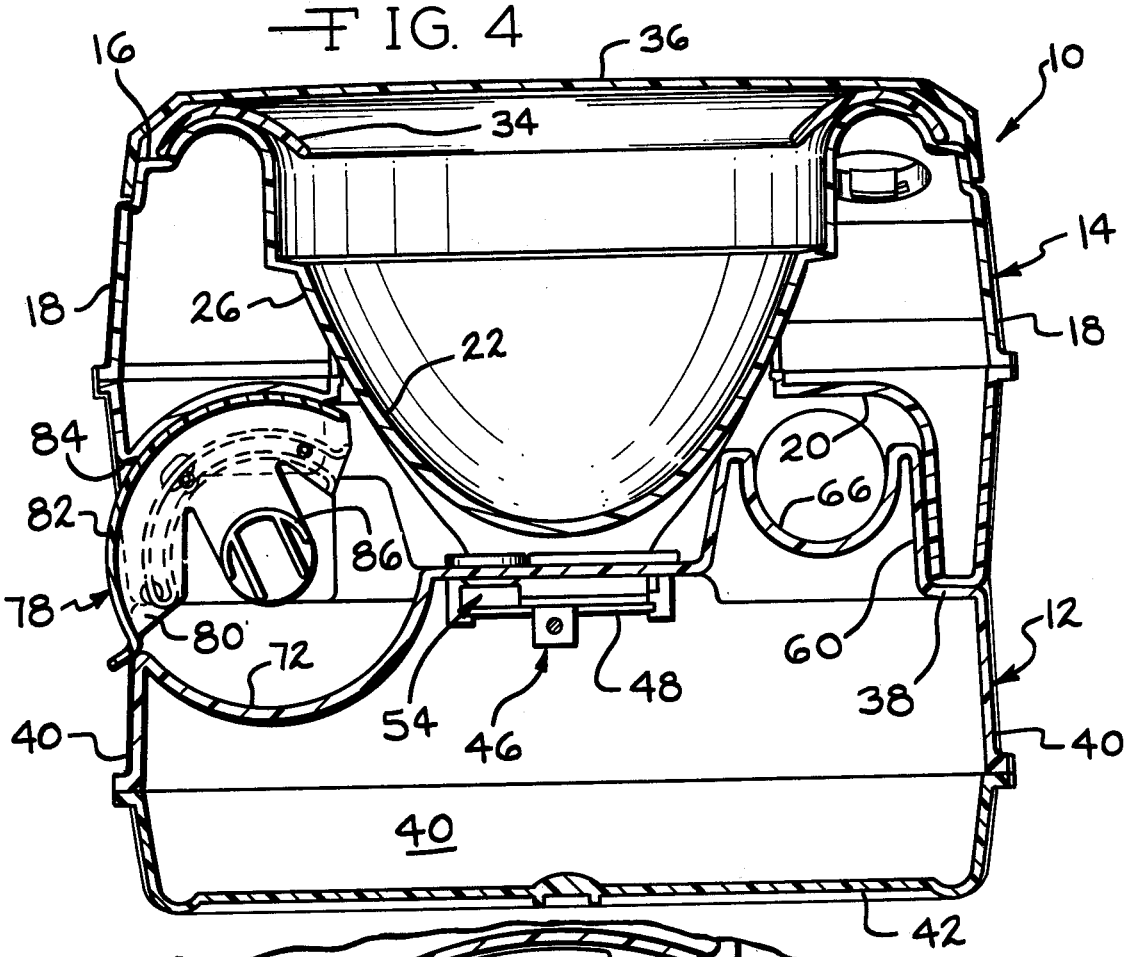
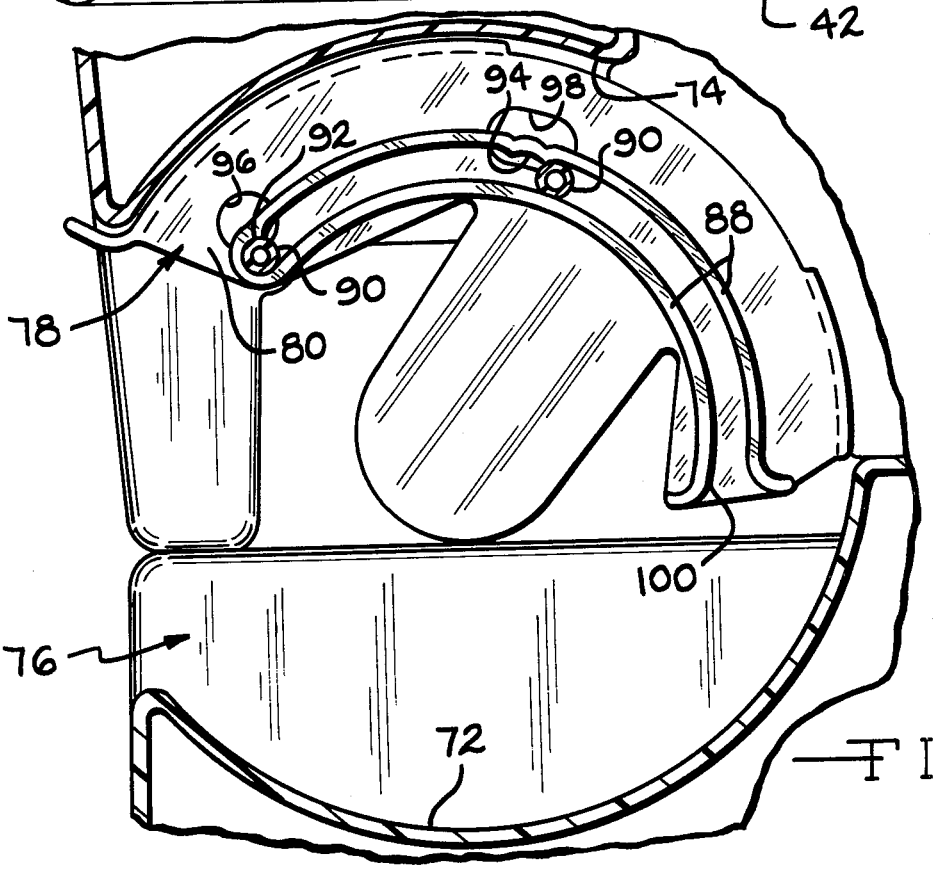
FIG. 5

PORTABLE TOILETS

TECHNICAL FIELD

The present invention relates to self-contained portable toilets of the type having two vertically stacked sections, the lower section being a holding tank and the upper section including a toilet bowl, flush water tank and flush apparatus; and more particularly to improvements in known portable toilets of this type.

BACKGROUND ART

Examples of known portable toilets to which the present invention relates are disclosed in U.S. Pat. No. 3,570,018, patented Mar. 16, 1971 in the names of Sargent et al.; U.S. Pat. No. 3,949,430, patented Apr. 13, 1976 in the names of Miller et al.; and U.S. Pat. No. 4,145,773, patented Mar. 27, 1979 in the names of Sargent et al. Reference is also made to pending U.S. application, Ser. No. 957,799, filed Oct. 6, 1978 in the names of Frank T. Sargent et al.

Portable toilet of this character have holding tanks on which are removably mounted upper units which contain among other items, the toilet bowl, a flush water storage tank and flush apparatus for flushing waste material from the bowl into the holding tank. It is the conventional practice in each of these toilets to provide a valve assembly either on the outside or within the holding tank for opening and closing the tank inlet port that is in communication with the outlet port from the toilet bowl. The tank contains a discharge spout with a closure cap, the spout normally being located in one of the side walls of the holding tank where it is visable and below the liquid line of the tank when the latter is full. The improved holding tank disclosed in the aforementioned application Ser. No. 957,799 has its discharged spout located in its top wall with the opening of the spout at a level above that of the valve assembly. This construction and arrangement enables the user of the portable toilet to remove the closure cap and to introduce selected chemical preparations into the holding tank while the liquid contents are in the tank without the danger of spilling the contents. It also significantly reduces the sealing problems that are involved for assuring that leakage does not occur at the closure cap while the portable toilet is in use. Still further, it conceals the closure cap and spout when the portable toilet is in its assembled position to provide a more attractive portable toilet.

SUMMARY OF THE INVENTION

The present invention provides a self-contained portable toilet that embodies improved features that provide still additional advantages in their use over the prior art toilets discussed above.

According to one form of the present invention, a portable toilet is provided comprising a portable lower holding tank section and a portable upper seat section removably secured thereon. The seat section has walls that define a flush water storage tank and a toilet bowl with an outlet port at its bottom, and means for discharging flush water from the storage tank into the toilet bowl. The holding tank section has walls that define a closed receptacle with an inlet port in its top wall in registry with the outlet port of the seat section, and the holding tank section has a valve assembly for opening and closing the inlet port. One of the features of this portable toilet is that the holding tank and seat sections define between them at least one storage chamber for storage of a material to be used in conjunction with the portable toilet and to be deposited in the holding tank, either through the spout in the holding tank or through the valve assembly.

It is conventional practice when using portable toilets of this character to introduce a chemical material, such as a deodorant, into the holding tank. In usual practice, this requires the user of the portable toilet to carry or have available a supply of the chemical concentrate in a separate container which can be stored adjacent to the portable toilet, or in transit, must be carried as a separate item.

In a prefered form of the present invention, a portable toilet is provided which has a spout in its top wall according to teachings disclosed in the above cited U.S. application Ser. No. 957,799, but a recess has been provided in the top wall extending at least partially along the length of the spout in which a container can be retained for storage of the material to be deposited in the holding tank. By virtue of this construction and arrangement, the storage chamber together with the container is enclosed by the seat section so that access to the container can be had only when the seat section is removed from its supported position on the holding tank section. This arrangement not only enables the user to have ready access to the container and its contents, but it also prevents unauthorized use of the material in the container, such as might occur if small children or others were permitted to tamper with the container. By virtue of the fact that the recess is partially in the raised spout, an insignificant volume of the holding tank is utilized for storage purposes.

It is the usual practice to manufacture holding tanks of plastics materials. Another feature of this embodiment of the invention is that during the molding operation fastening means or detent means are molded in the recess which can be used to retain the container firmly in place so that it does not vibrate or rattle during transit.

Still another feature of the present invention is the location of another storage chamber in a recess in the bottom wall of the seat section which is shaped so that a dispenser for toilet tissue paper can be stored therein and paper dispensed therefrom. In a prefered form of the invention embodying this feature, the holding tank and seat sections define between their adjacent top and bottom walls and at one of their associated side walls a storage chamber having an access opening through the associated side walls, the storage chamber including recesses in the bottom wall of the seat section and a top wall of the holding tank section shaped to enclose the holder for the toilet tissue paper, and a toilet paper holder is mounted in the storage chamber so that the toilet tissue paper can be removed through the access opening. In this form of the invention the toilet paper holder includes a cover for the access opening, the holder being mounted in the storage chamber for movement between a first position in which the cover closes the access opening and a second position in which the cover is retracted so that the toilet tissue paper can be removed. The storage chamber has a cylindrical configuration, and the holder is a segment of a cylindrical container that includes end wall portions having axially aligned bosses on which the core of a roll of toilet paper can be mounted, and an inter-connecting cylindrical wall portion forms the cover. The end wall portions and the adjacent walls of the storage chamber have cooperating track and follower means on which the holder is rotated between first (or closed) and second (or open) positions of the cover. Preferably, these mounting means are in the portion of the chamber located within the recess of the seat section so that the roll of toilet paper will normally be supported in the upper unit.

Another feature of the cooperating track and follower means is that detent means are provided for retaining the holder in either its first or its second position. Thus, when transporting the portable toilet, the cover can be retained in its closed position so as to protect the toilet paper from exposure.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 1 is a front elevational view of a portable toilet embodying one form of the present invention;

FIG. 4 is a verticle section taken on the lines 4—4 of FIG. 2, showing details of storage chambers for toilet tissue paper and a container of chemical materials;

FIG. 5 is an enlarged fragmentary section through the storage chamber for the toilet paper, showing the holder for the toilet paper in its open or second position;

FIG. 6 is a top plan view of the lower holding tank section;

DESCRIPTION OF THE PREFERRED EMBODIMENT

Figure 2:
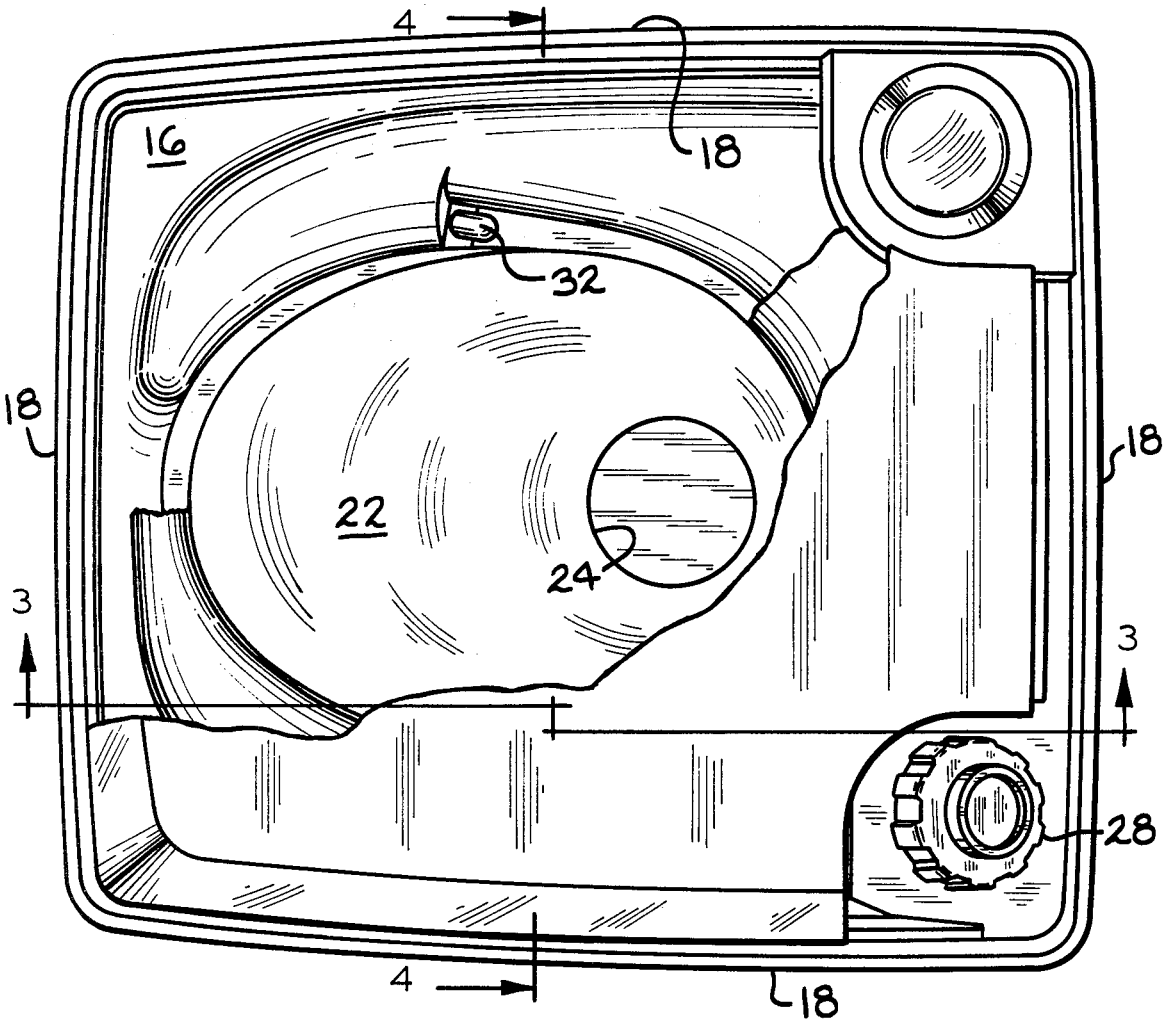
FIG. 2 is a top plan view of the portable toilet, portions of the cover and toilet seat being broken for illustration purposes.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The portable toilet 10 comprises the lower holding tank section 12 and the upper seat section 14 removably supported thereon. The upper seat section 14 is molded of a suitable plastics material so as to have a top wall 16, sidewalls 18 and a bottom wall 20. The upper seat section 14 has additional walls that define the toilet bowl 22 which has an outlet port 24 at its bottom and a flush water storage tank 26 that extends around the exterior of the bowl 22. A fill spout which is closed by the closure cap 28 is provided for filling the flush water storage tank 26. A bellows-type hand pump 30 is connected to the flush water storage tank 26 and discharges through the nozzle 32 to provide flush apparatus for pumping flush water from the flush water storage tank 26 into the bowl 22. In the conventional manner, a toilet seat 34 and a cover 36 are hingedly connected to the top wall 16.

The lower holding tank section 12 has a top wall 38, side walls 40 and a bottom wall 42 forming a closed receptacle with an inlet port 44 in its top wall in registry with the outlet port 24 of the upper seat section 14. A slide valve assembly 46 is mounted on the holding tank section 12 and defines the inlet port 44. The slide valve assembly 46 includes the flat blade or valve element 48 which in the present embodiment is supported within the confines of the holding tank section 12 for movement in a horizontal plane perpendicularly to the axis of the inlet port 44 for closing the port and sealing the interior of the holding tank section 12 from the environment. A slide valve assembly such as is shown either in prior U.S. Pat. No. 3,949,430 or U.S. Pat. No. 4,145,773 may be used in connection with the present invention, and for more detailed description and explanation of the valve assemblies, reference is made to these patents.

Briefly, the slide valve assembly 46 includes a handle 50 to which the blade or valve element 48 is attached, and the handle extends through an opening in the front side wall 18 in a sealed relationship. Because the handle extends into the interior of the holding tank 12, a protective bellows 52 is fitted over the shaft of the handle 50 and is secured in sealed relationship thereto. In the manner set forth in the aforesaid U.S. Pat. No. 3,949,430, the blade 48 is supported between guide surfaces for movement between its closed position and its open position. A vent port means 54 of the type illustrated and described in U.S. Pat. No. 4,145,773 is also provided, and for a detailed explanation of this apparatus, reference is made to the cited patent. Briefly, the vent port means 54 relieves pressure buildup that may have occured in holding tank section 12.

The illustrated embodiment of the present invention also employs a disengagable interlocking means 56 and releasable clasp means 58 for securing the upper seat section 14 into the lower holding tank section 12. These components do not form a part of the present invention, and are fully disclosed in the aforesaid pending application Ser. No. 957,799 to which reference is made for a more complete description.

Figure 3:
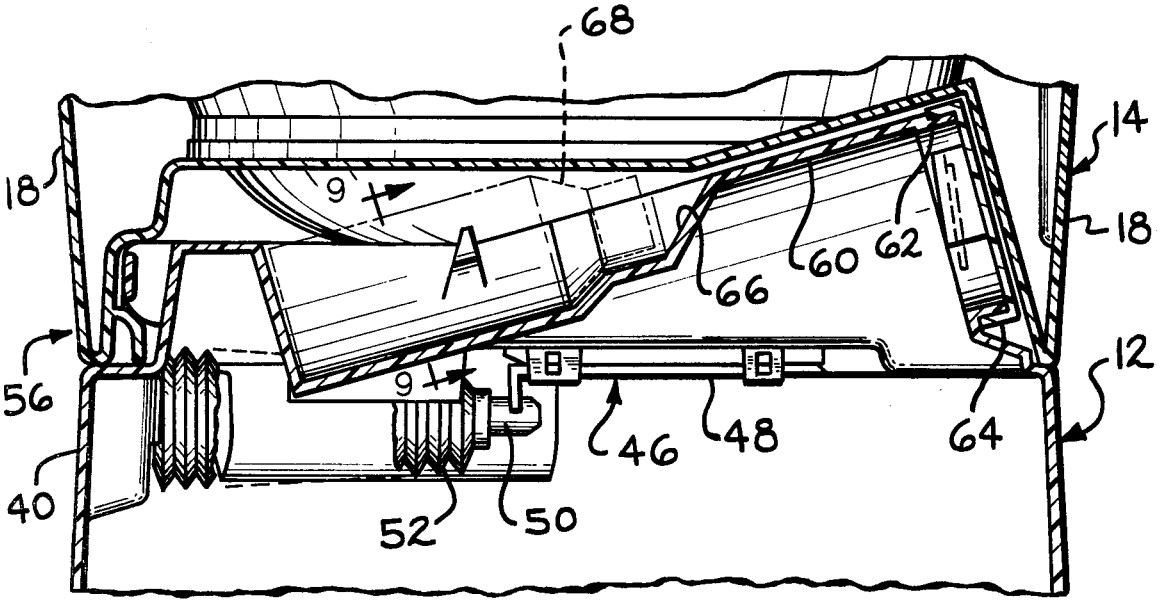
FIG. 3 is a fragmentary sectional view taken on the lines 3—3 of FIG. 2, showing a storage chamber for a container of chemical material located in a portion of the spout of the holding tank.
Figure 7:
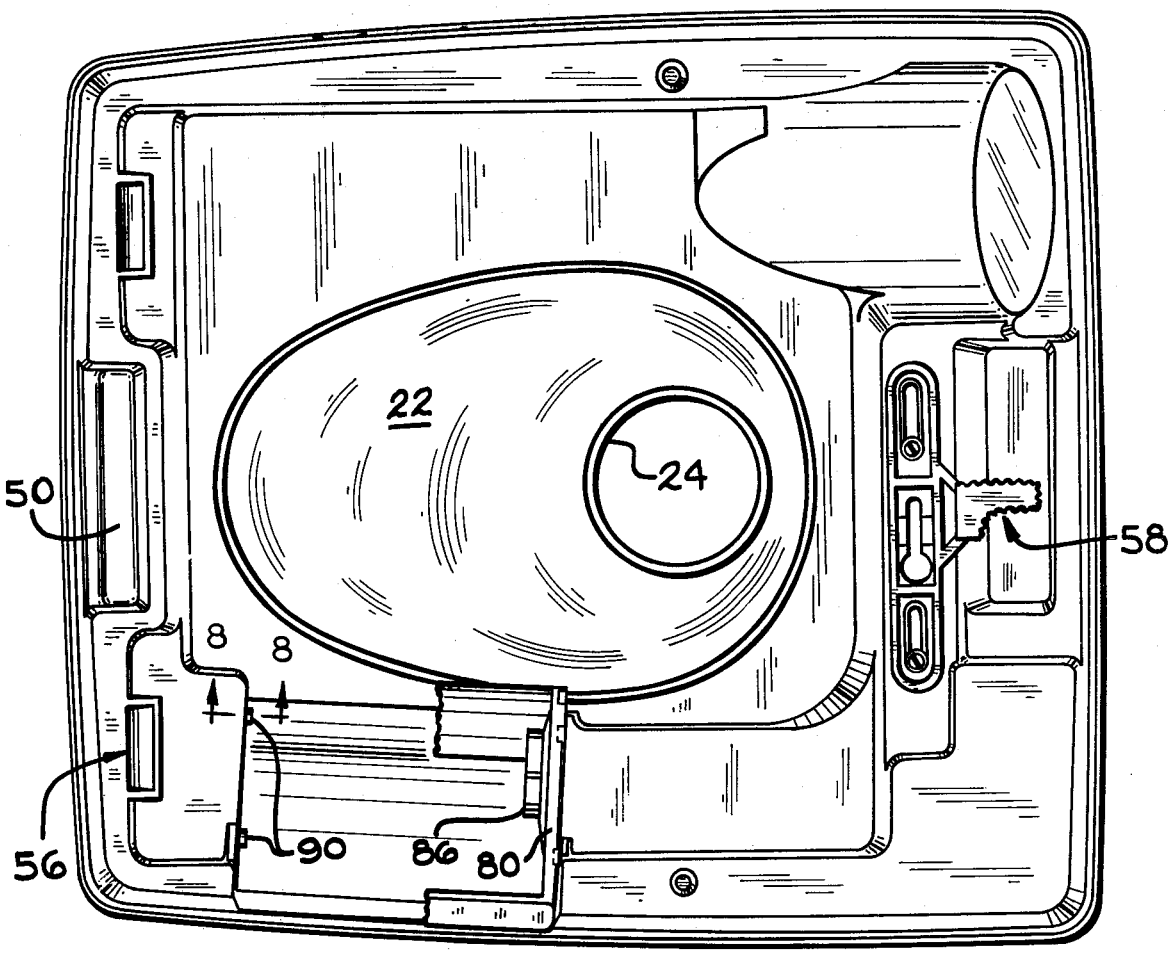
FIG. 7 is a bottom plan view of the upper seat section with portions of the toilet tissue paper holder broken away for illustration purposes.
Figure 8:
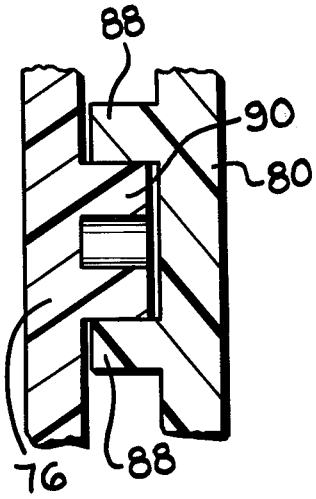
FIG. 8 is an enlarged fragmentary section taken on the lines 8—8 of FIG. 7, showing details of the track and follower means.
Figure 9:
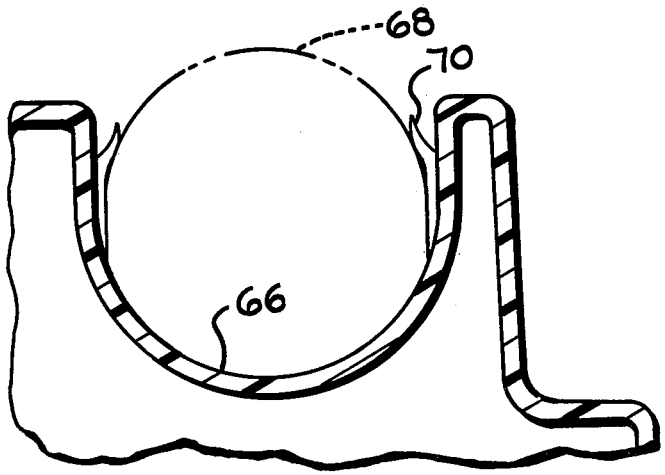
FIG. 9 is an enlarged fragmentary section taken on the lines 9—9 of FIG. 3.

As previously indicated, the top wall 38 of the holding tank 12 includes the discharge spout 60 which is located at an elevation above the valve assembly 46 and has its outlet 62 closed by the closure cap 64. As can be seen in FIG. 3, the spout 60 and the closure cap 64 are enclosed by the side walls 18 of the upper seat section 14. Formed in the top wall and extending lengthwise into the upwardly projecting spout 60 is a recess that defines a storage chamber 66 that is suitably shaped to receive a container 68 in which chemical material can be stored, of a type that normally is used in the holding tank section 12. To aid in retaining the container 68 firmly in place a fastening means or detent means 70 may be formed in the walls of the storage chamber 66 for frictionally engaging the container 68.

Also formed in the top wall 38 of the holding tank 12 is the recess 72 which together with the recess 74 in the bottom wall of the upper seat section 18 forms the storage chamber 76 in which a holder 78 for toilet tissue paper can be mounted.

The storage chamber 76 has a cylindrical configuration, and the holder 78 has end wall portions 80 and an interconnecting cylindrical wall portion forming the cover 82 to close the access opening 84 that is provided in the side walls 18 and 40. The end wall portions 80 have axially aligned bosses 86 on which the core of a roll of toilet paper, not shown, can be mounted. The end wall portions 80 also have tracks 88 between which pins or followers 90 are adapted to travel. The followers 90 are integrally molded in the walls of the storage chamber 76, and particularly in the walls defined by the recess in the seat section 14 so that the holder 78 will be supported in the seat section 14 when the latter is removed from the holding tank section 12. As can be seen best in FIGS. 4 & 5, the holder 78 can be moved on the followers 90 to a first position (FIG. 4) wherein the cover 82 is closed, and it can be moved to a second position (FIG. 5) wherein the cover 82 is open. When the cover 82 is in the open position, the one follower 90 in each track 88 will be retained by the detent means 92, and when the cover 82 is in its closed position, the same follower will be retained by the detent means 94 so as to hold the cover in a closed position. To facilitate the action of the detent means 92 and 94, the wall portion 80 has apertures 96 and 98 so as to make the track 88 more resilient or flexible for snapping the detents 92 and 94 onto the follower 90. To remove the holder 78 from the storage chamber 76, the upper seat section 14 must be removed from the lower holding tank section 12, after which the holder 78 can be rotated sufficiently far to allow the followers 90 to pass through the open ends 100 of the tracks 88. Thus, the tracks 88 and followers 90 form cooperating track and follower means for supporting the holder 78 in the storage chamber 76 in either a first position in which the cover 82 is closed or a second position in which the cover 82 is open. In the open position toilet tissue paper can be removed from the storage chamber. Further, the storage chamber for the toilet tissue paper will serve to maintain a supply of toilet tissue paper within the confines of the portable toilet 10, and similarly the storage chamber 66 will provide a storage space for the chemical ingredients that may be needed for the holding tank section 12.

It is claimed:

1. A portable toilet comprising a portable lower holding tank section and a portable upper seat section removably supported thereon, said seat section having walls that define a flush water storage tank and a toilet bowl with an outlet port at its bottom, and means for discharging flush water from the storage tank into the toilet bowl, said holding tank section having walls that define a closed receptacle with an inlet port in its top wall in registry with said outlet port, and said holding tank section having a valve assembly for opening and closing said inlet port, characterized in that said holding tank and seat sections define between them at least one storage chamber for storage of a material to be used in conjunction with the portable toilet and to be deposited in said holding tank.

2. A portable toilet according to claim 1, characterized in that said one storage chamber is a recess in the top wall of said holding tank, said recess in the top wall being shaped so that a container of chemical material for use in the holding tank can be stored therein.

3. A portable toilet according to claim 1, characterized in that said one storage chamber is a recess in a bottom wall of said seat section, said recess in the bottom wall being shaped so that a holder for toilet tissue paper can be stored therein and paper dispensed therefrom.

4. A portable toilet according to claim 1, characterized in that one storage chamber is a recess in the top wall of said holding tank, said recess in the top wall being shaped so that a container of chemical material for use in the holding tank can be stored therein, and another storage chamber is a recess in a bottom wall of said seat section, said recess in the bottom wall being shaped so that a holder for toilet tissue paper can be stored therein and paper dispensed therefrom.

5. A portable toilet comprising a portable lower holding tank section and a portable upper seat section removably supported therein, said seat section having top, side, and bottom walls and defining a flush water storage tank and a toilet bowl which has an outlet port at its bottom, and said seat section including flush apparatus for discharging flush water from the storage tank into the bowl, said holding tank section having a top wall and side and bottom walls forming a closed receptacle with an inlet port in its top wall in registry with said outlet port, the seat and holding tank sections each having at least one wall associated with a side wall of the other, the associated side walls being disposed generally one above the other, and said holding tank section having a valve assembly for opening and closing said inlet port, characterized in that said holding tank and seat sections define between their adjacent top and bottom walls and at one of their associated side walls a storage chamber having an access opening through the associated side walls, said storage chamber including recesses in the bottom wall of the seat section and the top wall of the holding tank section shaped to enclose a holder for toilet tissue paper, and a toilet paper holder mounted in said storage chamber so that toilet tissue paper can be removed through the access opening.

6. A portable toilet according to claim 5, characterized in that the toilet paper holder includes a cover for said access opening, and said holder is mounted in said storage chamber for movement between a first position in which the cover closes said access opening and a second position in which the cover is retracted so that toilet tissue paper can be removed through the access opening.

7. A portable toilet according to claim 6, characterized in that said storage chamber has a cylindrical configuration, and said holder is a segment of a cylindrical container that includes end wall portions having axially aligned bosses on which the core of a roll of toilet paper can be mounted and an interconnecting cylindrical wall portion forming said cover, said end wall portions and the adjacent walls of said storage chamber having cooperating track and follower means on which the holder can be rotated between the first and second positions of the cover.

8. A portable toilet according to claim 7, characterized in that said cooperating track and follower means includes detent means for retaining said holder in either its first or its second position.

9. A portable toilet according to claim 5, characterized in that said top wall of the holding tank section has a spout projecting upwardly, a removable closure cap is secured to the spout to close the upper end, the portable upper seat section encloses the spout and its removable closure cap, and said upwardly projecting spout has a storage chamber formed therein in which a container can be retained for storage of material to be deposited in the holding tank.

10. A portable toilet comprising a portable lower holding tank section and a portable upper seat section removably supported thereon, said seat section having top, side and bottom walls and defining a flush water storage tank and a toilet bowl which has an outlet port at its bottom and means for discharging flush water from the storage tank into the toilet bowl, said holding tank section having a top wall and side and bottom walls forming a closed receptacle with an inlet port in its top wall in registry with said outlet port, and said holding tank section having a valve assembly for opening and closing said inlet port, said top wall of the holding tank section having a spout projecting upwardly, and a removable closure cap secured to the spout to close the upper end, said portable upper seat section enclosing said spout and its removable closure cap, characterized in that said upwardly projecting spout has a storage chamber formed therein in which a container can be retained for storage of material to be deposited in said holding tank, said storage chamber being enclosed by the seat section so that access to a container therein can be had only when the seat section is removed from its supported position on said holding tank section.

11. A portable toilet according to claim 10, characterized in that said chamber has a configuration in the shape of a container, and fastening means are provided in said chamber for holding the container in position in said chamber.

* * * * *